United States Patent [19]

Ito

[11] 4,332,307

[45] Jun. 1, 1982

[54] EXHAUST MUFFLER

[75] Inventor: Hiroshi Ito, Iwata, Japan

[73] Assignee: Yamaha Hatsudoki Kabushiki Kaisha, Iwata, Japan

[21] Appl. No.: 201,774

[22] Filed: Oct. 29, 1980

[30] Foreign Application Priority Data

Oct. 31, 1979 [JP] Japan ..... 54-140586

[51] Int. Cl.[3] ..... F01N 1/24; F01N 1/08; F01N 7/00

[52] U.S. Cl. ..... 181/256; 181/272; 181/282

[58] Field of Search ..... 181/247, 252, 256–258, 181/272, 264, 282–283, 255

[56] References Cited

U.S. PATENT DOCUMENTS 4,111,278 2/1977 Bergman ..... 181/255 X

FOREIGN PATENT DOCUMENTS 511898 6/1952 Belgium ..... 181/282
1255519 1/1961 France ..... 181/256
54-102434 8/1979 Japan ..... 181/256

*Primary Examiner*—L. T. Hix
*Assistant Examiner*—Thomas H. Tarcza
*Attorney, Agent, or Firm*—Donald D. Mon

[57] ABSTRACT

An exhaust muffler for an internal combustion engine. The muffler has a pair of half-shells which are held together to form a muffler chamber. The half-shell structure is internally lined with sound absorbing material. The chamber inside this material is divided into a plurality of compartments by partitions which at their edges abut only the sound absorbing material so as further to alternate the exhaust sounds.

6 Claims, 2 Drawing Figures

EXHAUST MUFFLER

FIELD OF THE INVENTION

This invention relates to exhaust mufflers for internal combustion engines.

BACKGROUND OF THE INVENTION

The present invention relates to improvements in an exhaust muffler of an autobicycle or the like, in which the inside space of a cylinder constructed by securing two semicylindrical halves to each other is defined into a plurality of compartments by a at least one partition so that the engine exhaust gases may be discharged to the outside after they are consecutively introduced into said plural compartments.

Generally speaking, when the exhaust noises of an engine are to be silenced, it is important to numerically reduce the exhaust noises, especially their high frequency components, which form a major cause of jarring of the ears. The high frequency components in the engine exhaust noises can be considerably reduced by arranging a sound absorbing element in an exhaust muffler. According to the prior art, this sound absorbing element is generally formed into a mat shape and is supported in the muffler by punched metal. It has such a great number of parts that its construction is complicated, thus inviting a problem that it has deteriorated producibility.

The present invention has been conceived in view of the circumstances thus far described and has as a major object to provide a muffler with a simpler construction, and better producibility than that according to the prior art.

Another object of the present invention is to provide a muffler which can also restrain the vibration noises (i.e., the so-called "shell noises") of the cylinder of the exhaust muffler caused by pressure fluctuations in the exhaust.

BRIEF DESCRIPTION OF THE INVENTION

A muffler according to this invention includes two shell halves which are held together to form a muffler chamber. The assembled halves are lined with a sound absorbing material. A at least one partition devide the compartment into a plurality of muffler chambers. The peripheral edge of the partition bears only against the sound absorbing material.

The invention will be fully understood from the following detailed description and the accompanying drawings, in which:

DETAILED DESCRIPTION OF THE INVENTION

Figure 1:
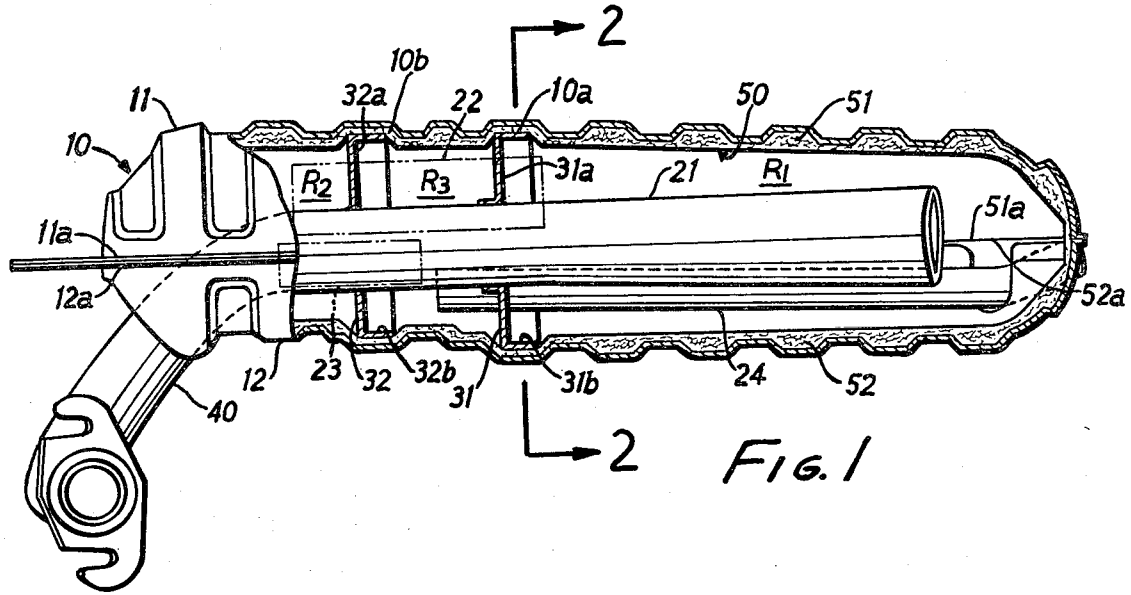
FIG. 1 is a top plan view, partly in cross-section, showing one embodiment of the exhaust muffler according to the present invention.
Figure 2:
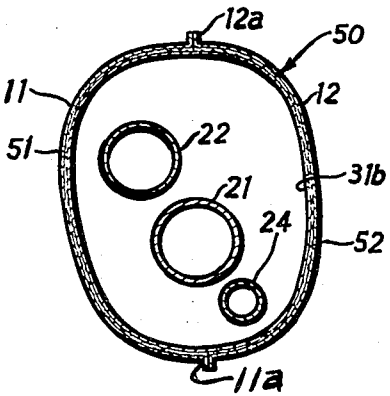
FIG. 2 is a longitudinal section taken along line 2—2 of FIG. 1.

FIGS. 1 and 2 show one embodiment of the exhaust muffler according to the present invention. This exhaust muffler is intended to be used with a small autobicycle, and is constructed of an outer cylinder 10, first, second, third and fourth diffuser pipes 21, 22, 23 and 24 arranged in the outer cylinder 10, and partitions 31 and 32 arranged in the outer cylinder 10 and supporting the outer cylinder 10 and the respective diffuser pipes 21 and 24 while defining the inside thereof into three compartments $R_1$, $R_2$ and $R_3$.

Outer cylinder 10 is composed of two outer shells 11 and 12, which are formed into generally the same semicylindrical shape, and is constructed by seam welding the flange portions 11*a* and 12*a*, which are formed at the open edges of the two outer shells 11 and 12. Flange portions 11*a* and 12*a* are forced into abutment against each other and seam welded in that condition. First diffuser pipe 21 is extended through wall portions 31*a* and 32*a* of respective partitions 31 and 32 into first and second compartments $R_1$ and $R_2$ until it has its one end opened at the rear end portion of the first compartment $R_1$ and its outer end welded and connected to one end of an exhaust pipe 40 while facing the outside of the outer shell 12 from the leading end side of the second compartment $R_2$. Incidentally, the first diffuser pipe 21 thus extended is further welded at intermediate portions between its end to wall portions 31*a* and 32*a* of respective partitions 31 and 32. Second diffuser pipe 22 is extended through wall portions 31*a* and 32*a* of respective partitions 31 and 32 into the first and second compartments $R_1$ and $R_2$ until it has one of its ends opened at the front end portion of the first compartment $R_1$ and its other end opened substantially at the center portion of the second compartment $R_2$. Second diffuser pipe 22 thus extended is also welded at locations between its ends to wall portions 31*a* and 32*a* of respective partitions 31 and 32. Third diffuser pipe 23 is extended through wall portion 32*a* of partition 32 into second and third compartments $R_2$ and $R_3$, with its ends opened substantially at the center portions of second and third compartments $R_2$ and $R_3$. It is welded at locations between its ends to wall portion of partition 32. Fourth diffuser pipe 24 is extended through wall portion 31*a* of partition 31 into first and third compartments $R_1$ and $R_3$ with one of its ends extended to the outside of the outer shell 12 from the rear end side of first compartment $R_1$ and its outer end opened substantially at the center portion of third compartment $R_3$. Fourth diffuser pipe 24 thus extended, is welded at locations between its ends to wall portion of partition 31 and to outer shell 12.

Thus, in said exhaust muffler, there is arranged within the outer cylinder 10 a sound absorbing element 50 which is mainly made of glass wool. This sound absorbing element 50 is composed of two inner shells 51 and 52 which are formed into semicylindrical shapes similarly to the outer cylinder 10. Respective inner shells 51 and 52 are made to have substantially the same outer circumferential shape as the inner circumferential shape of respective outer shells 11 and 12. Moreover, respective inner shells 51 and 52 are arranged in outer cylinder 10 under the condition in which they have their respective open ends 51*a* and 52*a* abutting against each other, and are sandwiched between internal recesses 10*a* and 10*b* of outer cylinder 10 and outer circumferential edge portions (or flange portions) 31*b* and 32*b* of respective partitions 31 and 32 under the condition in which their outer circumferences are in abutment against the inner circumference of the outer cylinder 10. Respective inner shells 51 and 52 are molded by the hot pressing process after mat-shaped glass wool has been dipped in an aqueous solution of such an inorganic binder as contains 30 wt. % of inorganic silica, 2 wt. % of starch and 1.5 wt. % of a penetrant. When respective inner shells 51 and 52 are to be molded, refractory silicone rubber may be applied during the hot pressing process so as to improve the appearance shape, the surface density, and the surface hardness, if necessary. In an alternative, a refractory adhesive such as plain malt may be applied to prevent the surface fibers from being scattered. These applications are especially effective when respective inner shells 51 and 52 are made of a web of short glass fibers. Alternately, respective inner shells 51 and 52 may be made of a combination of a web of short fibers and a web of long fibers. In this instance, the use of the long fiber web such that is positioned on the inner surfaces of respective inner shells 51 and 52 is remarkably effective.

In the exhaust muffler having the construction thus far described, the exhaust from the unillustrated engine is introduced through exhaust pipe 40 and first diffuser pipe 21 into first compartment $R_1$. This exhaust is then introduced through second diffuser pipe 22 into second compartment $R_2$, and further through third diffuser pipe 23 into third compartment $R_3$, until it is discharged to the outside through fourth diffuser pipe 24. In the course of this flow, the exhaust gas is further cooled down, while repeating its expansions and diffusions in the exhaust muffler, thereby to silence the exhaust noises. Here, while the exhaust is being introduced into the exhaust muffler, the outer cylinder 10 will vibrate due to the pressure fluctuations in the exhaust gases in the exhaust muffler. In the exhaust muffler of this invention, because respective partitions 31 and 32 are not welded to the outer cylinder 10 but merely have their outer circumferential edge portions 31*b* and 32*b* sandwiched between respective outer shells 11 and 12 through sound absorbing element 50 (which is a molding made mainly of the glass wool), there is established a relative shift, when outer cylinder 10 is deformed by pressure fluctuations in the exhaust, at the contact surface of outer cylinder 10 and sound absorbing element 50 and at the contact surface of sound absorbing element 50 and outer circumferential edge portions 31*b* and 32*b*, thereby to generate frictions whereby the vibration energy is attenuated. As a result, the vibrations of the outer cylinder 10 due to the pressure fluctuations in the exhaust are restrained. As a result, the generation of shell noises that are jarring to one's ears can be effectively restrained so that uncomfortable noises are not released to the outside. Moreover, because sound absorbing element 50 is constructed of such a molding as has substantially the same outer circumference shape as the inner circumferential shapes of respective outer shells 11 and 12 and is sandwiched between the inner circumference of outer cylinder 10 and outer circumferential edge portions 31*b* and 32*b* of respective partitions 31 and 32, another special supporting member is not required for supporting the sound absorbing element 50. This makes it possible to provide such an exhaust muffler at a lower cost, because it has a simpler construction than that of the conventional exhaust muffler which has its mat-shaped sound absorbing element supported by a punching metal or the like. Also, since sound absorbing element 50 is a molding which has a sufficient shape-maintaining property by itself, its handling and assembly are facilitated, and it can have excellent durability.

This invention can be practiced in a variety of exhaust mufflers of the type in which the inside space of a cylinder constructed by securing two semicylindrical halves to each other is defined into plural compartments by at least one partition so that the engine exhaust gases may be discharged to the outside after they are consecutively introduced into said plural compartments. For example, the practices of the present invention can be effected by suitably changing the shape of the cylinder 10, and the shapes and numbers of the respective diffuser pipes and the respective partitions in the embodiment thus far described.

As is apparent from the foregoing description, in the aforementioned various exhaust mufflers, the present invention is constructionally characterized in that two semicylindrical sound absorbing elements, which are made mainly of the glass wool and which are so molded as to have the outer circumferences of substantially the same shape as those of the inner circumferences of semicylindrical halves, are arranged within said cylinder such that they abut against the inner circumference of said cylinder, and in that partitions are arranged in said cylinder such that said sound absorbing elements are sandwiched between said cylinder and the outer circumferential edge portions of said partitions, respectively. According to the present invention, therefore, it is possible to provide an exhaust muffler, which is simple in construction, and feasible in assembly, while making it unnecessary to use a special supporting member such as punching metal in order to support the sound absorbing elements.

Due to the pressure fluctuations in the exhaust, moreover, a relative shift is established at the contact surface of the outer cylinder and the sound absorbing elements and at the contact surface of the sound absorbing elements and the outer circumferential edge portions of the partitions, even if the outer cylinder is to vibrate, thereby to generate frictions in between, whereby the vibration energy can be attenuated to restrain the generation of shell noises.

This invention is not to be limited by the embodiment shown in the drawing and described in the description, which is given by way of example and not of limitation, but only in accordance with the scope of the appended claims.

I claim:

1. An exhaust muffler comprising: a tubular outer shell comprised of two pieces, each having an inner wall, said pieces being joined together at a pair of longitudinal seams, and together forming an inside space; a tubular sound absorbing member comprised of two elements having inner and outer surfaces, said outer surfaces being shaped to conform to, and abut against said inner walls of said outer shell, said inner surfaces of said sound absorbing member forming a cavity; a partition dividing said cavity into a plurality of compartments; a diffuser pipe interconnecting said compartments; exhaust inlet means to one of said compartments, and exhaust outlet means from the other of said compartments; a peripheral groove in said inside surface of said elements; a peripheral flange on said partition seated in said peripheral groove and having a substantial area of contact with said inner surfaces of said elements, thereby being restrained against substantial movement of said partition longitudinally in said groove in said sound absorbing element.

2. An exhaust muffler according to claim 1 in which said two sound absorbing elements are semicylindrical and have a substantial dimension of thickness.

3. An exhaust muffler according to claim 2 in which the two semicylindrical sound absorbing elements are principally made of glass wool.

4. An exhaust muffler according to claim 1 in which there is a plurality of said partitions, dividing said cavity into more than two of said compartments, and in which sufficient additional diffuser pipes are provided that each compartment is connected to at least one other compartment.

5. An exhaust muffler according to claim 1 in which one of said inner wall of said pieces and said outer surface of said elements has a peripheral groove, and in which said other one has a peripheral shoulder fitting in said last-named groove whereby to provide restraint against substantial movement of said sound absorbing element longitudinally in said groove in said outer shell.

6. An exhaust muffler according to claim 5 in which there is a plurality of said partitions, dividing said cavity into more than two of said compartments, and in which sufficient additional diffuser pipes are provided that each compartment is connected to at least one other compartment.

* * * * *